US012704285B2

(12) United States Patent
Bursill

(10) Patent No.: US 12,704,285 B2
(45) Date of Patent: Aug. 11, 2026

(54) CONTROL ENGINE SYSTEM AND METHOD

(71) Applicant: Delta Intelligent Building Technologies (Canada) Inc., Surrey (CA)

(72) Inventor: Jayson Frederick Bursill, Gloucester (CA)

(73) Assignee: Delta Intelligent Building Technologies (Canada) Inc., Surrey (CA)

( * ) Notice: Subject to any disclaimer, the term of this patent is extended or adjusted under 35 U.S.C. 154(b) by 402 days.

(21) Appl. No.: 18/406,768

(22) Filed: Jan. 8, 2024

(65) Prior Publication Data

US 2024/0230135 A1 Jul. 11, 2024

Related U.S. Application Data

(60) Provisional application No. 63/437,775, filed on Jan. 9, 2023.

(51) Int. Cl.
*F24F 11/63* (2018.01)

(52) U.S. Cl.
CPC ..... *F24F 11/63* (2018.01)

(58) Field of Classification Search
None
See application file for complete search history.

(56) References Cited

U.S. PATENT DOCUMENTS 10,921,760 B2 * 2/2021 Harvey ..... G05B 17/02
11,567,490 B2 1/2023 Khalate et al.
11,579,595 B2 2/2023 Chauvet et al.
11,733,662 B2 8/2023 Harvey
(Continued)

FOREIGN PATENT DOCUMENTS

CN 114332540 A 4/2022
CN 116451153 A * 7/2023

OTHER PUBLICATIONS

Bursill, "Multi-zone field study of rule extraction control to simplify implementation of predictive control to reduce building energy use", 2022, www.elsevier.com/locate/enbuild (Year: 2022).*
(Continued)

*Primary Examiner* — Hossain M Morshed
(74) *Attorney, Agent, or Firm* — Kirton McConkie; Evan R. Witt

(57) ABSTRACT

The present disclosure provides a control engine system connected to a BAS, the control engine system includes a data preprocessing engine, a random forest generator, a tree selector, and a BAS code generator. The data preprocessing engine receives a data from the BAS and is configured for performing preprocessing on the data and generating a training data accordingly. The random forest generator is connected to the data preprocessing engine, the random forest generator receives the training data and generates a random forest accordingly. The tree selector is connected to the random forest generator, and the tree selector receives the random forest for selecting a final decision tree. The BAS code generator is connected to the tree selector, the BAS code generator receives the final decision tree and encodes a supervisory decision tree according to the final decision tree, the BAS code generator outputs the supervisory decision tree to the BAS.

15 Claims, 9 Drawing Sheets

(56) References Cited

U.S. PATENT DOCUMENTS

| | | | | |
|---|---|---|---|---|
| 2017/0169344 | A1 | 6/2017 | Mangharam et al. | |
| 2018/0180314 | A1 | 6/2018 | Brisette et al. | |
| 2018/0231967 | A1 | 8/2018 | Cohen et al. | |
| 2019/0187634 | A1* | 6/2019 | Fan | F24F 11/65 |
| 2020/0293906 | A1* | 9/2020 | Xu | G06N 20/20 |
| 2020/0311559 | A1* | 10/2020 | Chattopadhyay | G06N 5/01 |
| 2020/0326676 | A1 | 10/2020 | Perez et al. | |
| 2022/0373209 | A1* | 11/2022 | Ko | F24F 11/63 |
| 2023/0076947 | A1 | 3/2023 | Rasmus-Vorrath et al. | |
| 2023/0304690 | A1* | 9/2023 | Simmons | F24F 11/32 |
| 2024/0230135 | A1* | 7/2024 | Bursill | F24F 11/63 |

OTHER PUBLICATIONS

Smarra, "Data-driven model predictive control using random forests for building energy optimization and climate control", 2018, www.elsevier.com/locate/apenergy (Year: 2018).*

Jayson Bursill, "An approach to data-driven sensing and predictive supervisory control for commercial buildings with in-situ evaluation", thesis submitted to Department of Mechanical and Aerospace Engineering, Carleton University, Apr. 2020.

Magnus Hammar, System 800xA Update, Control Technologies (abb.com), Mar. 30, 2023.

Jayson Bursill et al., "Multi-zone field study of rule extraction control to simplify implementation of predictive control to reduce building energy use", Energy and Buildings, vol. 222, 2020.

Smarra Francesco et al., Data-driven model predictive control using random forests for building energy optimization and climate control, Applied Energy, 2018, pp. 1252-1272.

* cited by examiner

CONTROL ENGINE SYSTEM AND METHOD

CROSS-REFERENCE TO RELATED APPLICATION

This application claims the benefit of U.S. Provisional Application No. 63/437,775, filed on Jan. 9, 2023, entitled "SYSTEM AND METHOD FOR MPC MODEL GENERATION AND INTEGRATION". The entire contents of the above-mentioned patent application are incorporated herein by reference for all purposes.

FIELD OF THE INVENTION

The present disclosure relates to a control engine system and method for building automation systems (BAS).

BACKGROUND OF THE INVENTION

Building automation systems (BAS) control heating, ventilation, and air conditioning (HVAC) systems by using a variety of zone-level sensors and data from outdoor ambient sensors. However, most of the BASs operate sub-optimally for a variety of reasons. Model-based predictive control (MPC) can offer a software-based solution that involves system identification and optimization to provide near-optimal control response for multiple input multiple output (MIMO) systems.

MPC is often difficult to configure and requires multiple layers of embedded modeling. Linking the algorithm with the correct features as a subset of the system states, inputs, disturbances, and controlled outputs in the BAS is essential to MPC. Additionally, historical data for these features must be acquired and processed if data-driven approaches are used. These processes using historical data requires customized solutions for each site and underlying algorithm. The number of required steps and complexity of integration perpetuates a common criticism of MPC that there is a knowledge barrier for implementing and configuring it on a real building when custom solutions and processes are required for every project.

The implementation of MPC typically requires a significant volume of time series thermo-physical data to train models. In addition, the mathematical operator requirements for even basic optimization schemes often require computational resources beyond what is available in the building control edge devices, such as direct exchange (DX), variable air volume (VAV), and air handling unit (AHU) controllers, that are deployed in the majority of existing building automation systems. The result of most historical MPC implementations has better performance but a complicated system that is opaque to building operators and difficult to debug for non-experts. Thus, there is often apprehension in implementing MPC in-situ on live sites where there are concerns with respect to liability and risk.

Therefore, there is a need for a streamlined process and accompanying tooling to configure MPC and related algorithms using a graphical software interface that can be used by practitioners in the field. Also, there is a need for fundamental manifestations of MPC and other complicated building control algorithms that can deliver comparable performance but also be easy to understand and debug. Encapsulated within this is a need for a process to create data-driven fundamental predictive control that can hook into contemporary algorithms.

Therefore, there is a need of providing a control engine system and method to obviate the drawbacks encountered from the prior arts.

SUMMARY OF THE INVENTION

It is an object of the present disclosure to provide a control engine system and method. In the control engine system and method, an approach to generating empirical rule extraction heuristics to fundamental control processes is disclosed. The process may utilize feature data from the BAS from selected features of VAV, AHU and/or BAS controllers (and/or other building systems) that are mapped to system states, inputs, disturbances (e.g., thermal sensors), and/or controlled outputs (e.g., system mode). In some embodiments, the decision trees capable of representing the optimal tree for both simplicity and maintenance of the abstracted and extracted algorithm may be applied for systems to reselect only the most impactful features for system mode of the underlying system. The decision trees can then be applied to adjust the system mode based on the thermal sensor behavior from historical time series data. This process results in comparable energy savings to detailed algorithms while also being explainable to field practitioners.

In accordance with an aspect of the present disclosure, there is provided a control engine system connected to a BAS, the control engine system includes a data preprocessing engine, a random forest generator, a tree selector, and a BAS code generator. The data preprocessing engine is adapted to receive a data from the BAS and configured for performing preprocessing on the data and generating a training data accordingly. The random forest generator is connected to the data preprocessing engine, the random forest generator is configured to receive the training data and generate a random forest according to the training data. The tree selector is connected to the random forest generator, and the tree selector is configured to receive the random forest for selecting a final decision tree. The BAS code generator is connected to the tree selector, the BAS code generator is configured to receive the final decision tree and encode a supervisory decision tree according to the final decision tree, and the BAS code generator is configured to output the supervisory decision tree to the BAS.

In accordance with an aspect of the present disclosure, there is provided a control engine method applicable for a control engine system, wherein the control engine system includes a data preprocessing engine, random forest generator, a tree selector, and a BAS code generator, and the control engine method includes steps of: (a) obtaining a data from a BAS and determining a feature data corresponding to the data; (b) receiving the feature data corresponding to the data; (c) performing a preprocessing to the feature data by the data preprocessing engine; (d) generating a random forest corresponding to the BAS using the feature data by the random forest generator; (e) selecting a final decision tree according to the random forest by the tree selector; and (f) generating a supervisory decision tree according to the final decision tree by the BAS code generator, wherein the supervisory decision tree is applied to the BAS.

In accordance with an aspect of the present disclosure, there is provided a control engine method for a MPC configuration. The control engine method for the MPC configuration includes steps of: (g) receiving preprocess data from the BAS; (h) fitting a MPC model to the preprocess data and tunning a MPC parameters of the MPC model for a desired optimal performance of a control object; (i) writing the MPC model into the BAS to override an original control of the BAS; and (j) evaluating a performance of the MPC model.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
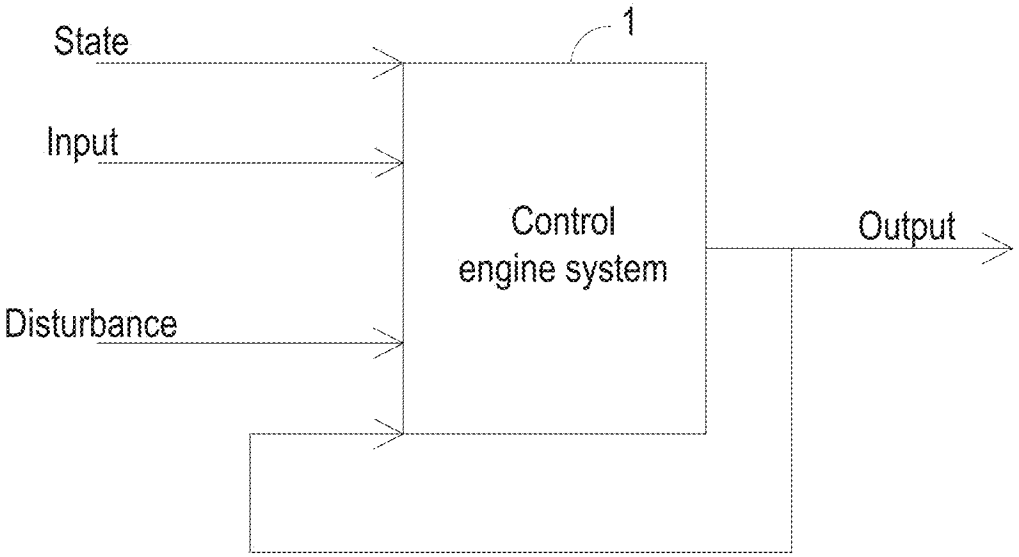
FIG. 1 is a schematic diagram of a control engine system according to an embodiment of the present disclosure.
Figure 2:
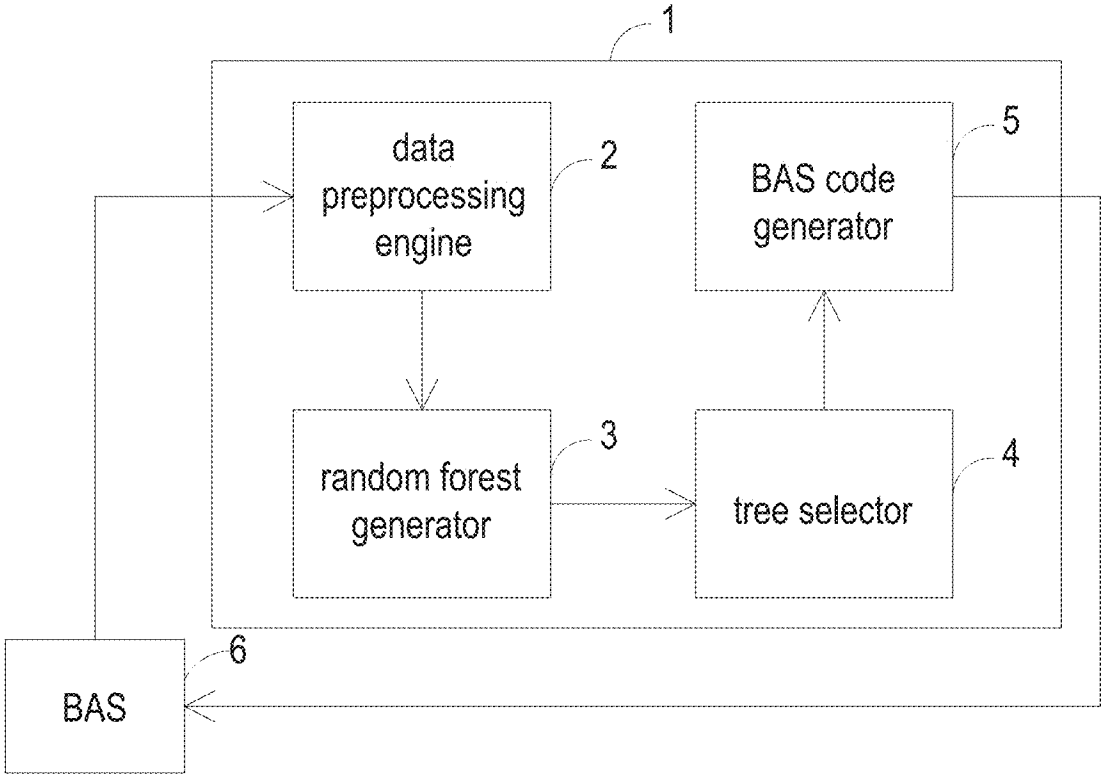
FIG. 2 is a schematic diagram of a control engine system for use with a BAS according to another embodiment of the present disclosure.

FIG. 1 is a schematic diagram of a control engine system 1 according to an embodiment of the present disclosure. Please refer to FIG. 1, the control engine system 1 is adapted to receive at least one of a state, an input and a disturbance from device or system to be controlled and output an algorithmic output to a BAS controller setpoint, a physical output or other desired controllable point. In an embodiment, the control engine system 1 is for example but not limited to an agnostic control engine (ACE). The ACE can accept multiple inputs (including disturbances represented as inputs in the canonical state-space format) and multiple outputs to represent MIMO systems. The control engine system 1 can be implemented in a cloud control platform, a control system operating on one or more computing devices, or distributed over a cloud and/or hybrid system, etc. FIG. 2 is a schematic diagram of a control engine system 1 for use with a BAS 6 according to another embodiment of the present disclosure. As shown in the embodiment in FIG. 2, the control engine system 1 is connected to the BAS 6, the control engine system 1 is configured to receive data from the BAS 6 and output a supervisory decision tree to the BAS 6. In an embodiment, the data from the BAS 6 includes at least one of a control structure and a thermal sensor data. The control engine system 1 includes a data preprocessing engine 2, a random forest generator 3, a tree selector 4, and a BAS code generator 5. The data preprocessing engine 2 is adapted to receive data from the BAS 6 and configured for performing preprocessing on data and generating a training data accordingly. The random forest generator 3 is connected to the data preprocessing engine 2, the random forest generator 3 is configured to receive the training data and generate a random forest according to the training data. The tree selector 4 is connected to the random forest generator 3, and the tree selector 4 is configured to receive the random forest for selecting a final decision tree. In an embodiment, the tree selector 4 includes a criteria-based indicative tree selector. The BAS code generator 5 is connected to the tree selector 4, the BAS code generator 5 is configured to receive the final decision tree and encode the supervisory decision tree according to the final decision tree, and the BAS code generator 5 is adapted to output the supervisory decision tree to the BAS 6.

The control structure of the BAS 6 is identified to determine the features selected to represent states, inputs, and disturbances in the form of, for example thermal sensor data. In an embodiment, controlled parameters or outputs are identified, controlled outputs may be also likely to be system inputs if the underlying control is closed loop. The previously described time series data from the selected features is then mapped and fed back to the control engine system 1 to generate models for closed loop control shown in FIG. 1.

In an embodiment, the data preprocessing engine 2 of the control engine system 1 is configured to receive and normalize the data from the BAS 6 to fill missing values. In an embodiment, the control engine system 1 is adapted to fill missing values by using interpolation for continuous data and previous value for event-based data. The normalized data is then sliced and shuffled stochastically to produce multiple unique 50-50 train-test splits for cross-validation. The number of uniquely shuffled datasets generated from the original sample data matches the number of trees that may be generated in the random forest for each control algorithm that is to be abstracted and extracted to allow for rapid and simultaneous random forest modeling. The data is shuffled to prevent overfit and allow for multiple similar systems to have a single representative heuristic solution to improve implementation efficiency.

The random forest generator 3 of the control engine system 1 is adapted to receive the training data from the data preprocessing engine 2 and generate a statistically significant random forest of classification trees using a classification and regression tree (CART) algorithm. In an embodiment, a default random forest of 1,000 trees is generated to achieve statistical significance while maintaining computational speed.

Figure 3:
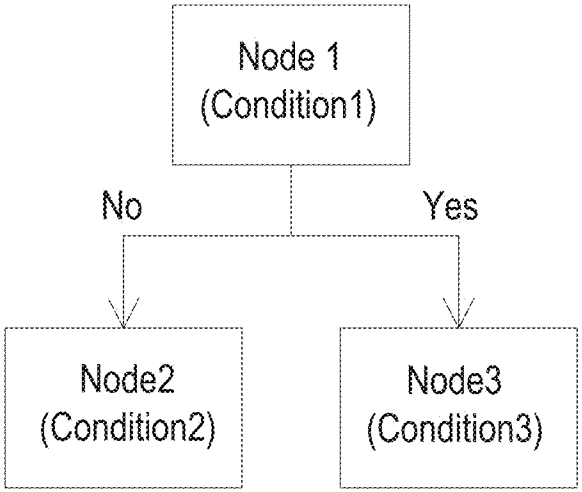
FIG. 3 is a schematic diagram of a tree with three nodes generated by the tree selector in FIG. 2.
Figure 4:
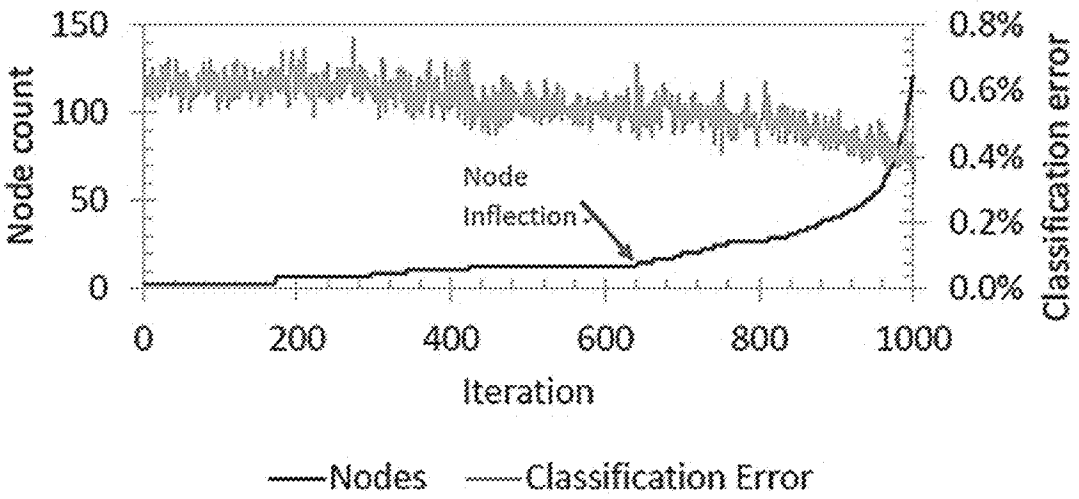
FIG. 4 and FIG. 5 schematically show embodiments of the decision tree node selection criteria.
Figure 5:
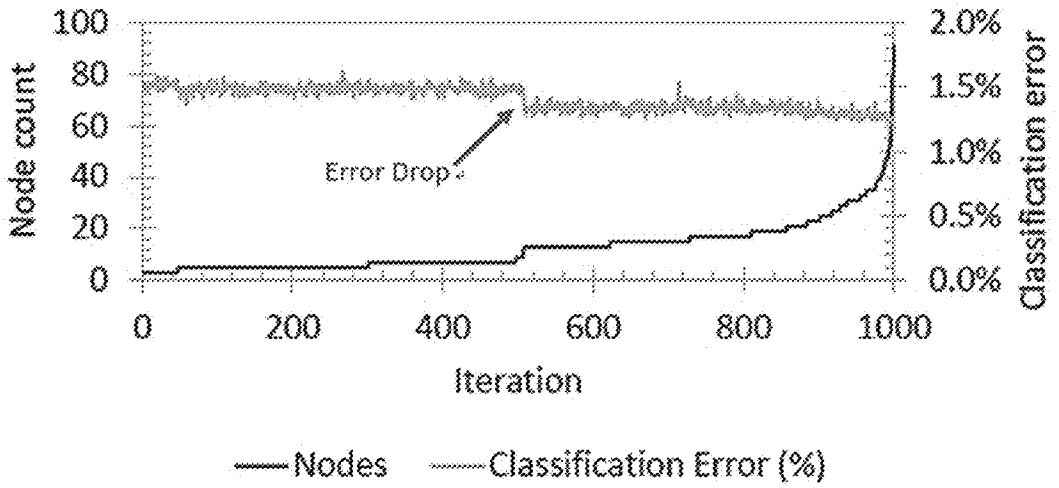

The random forest generated by the random forest generator 3 is then sorted by node count, and the marginal error between node tiers is used to determine the number of nodes on the decision tree to produce a fundamental and accurate heuristic final decision tree by the tree selector 4. The number of the nodes is for example but not limited to three (shown in FIG. 3). In an embodiment, the node represents the determination condition of the data received from the BAS 6. If between node count clusters either the moving average of the error drops by >10% coefficient of variation root-mean-squared error (CV-RMSE) or the continuous node count begins to inflect then the selection process stops at the preceding node count, and the mentioned above are shown in FIGS. 4 and 5 respectively. Once the number of nodes of the decision tree is identified, the median tree of that clustered node group is selected as the final decision tree.

The BAS code generator 5 receives the final decision tree from the tree selector 4 and encodes a supervisory decision tree according to the final decision tree in a suitable format, and the BAS code generator 5 outputs the final decision tree to the BAS 6.

Figure 6:
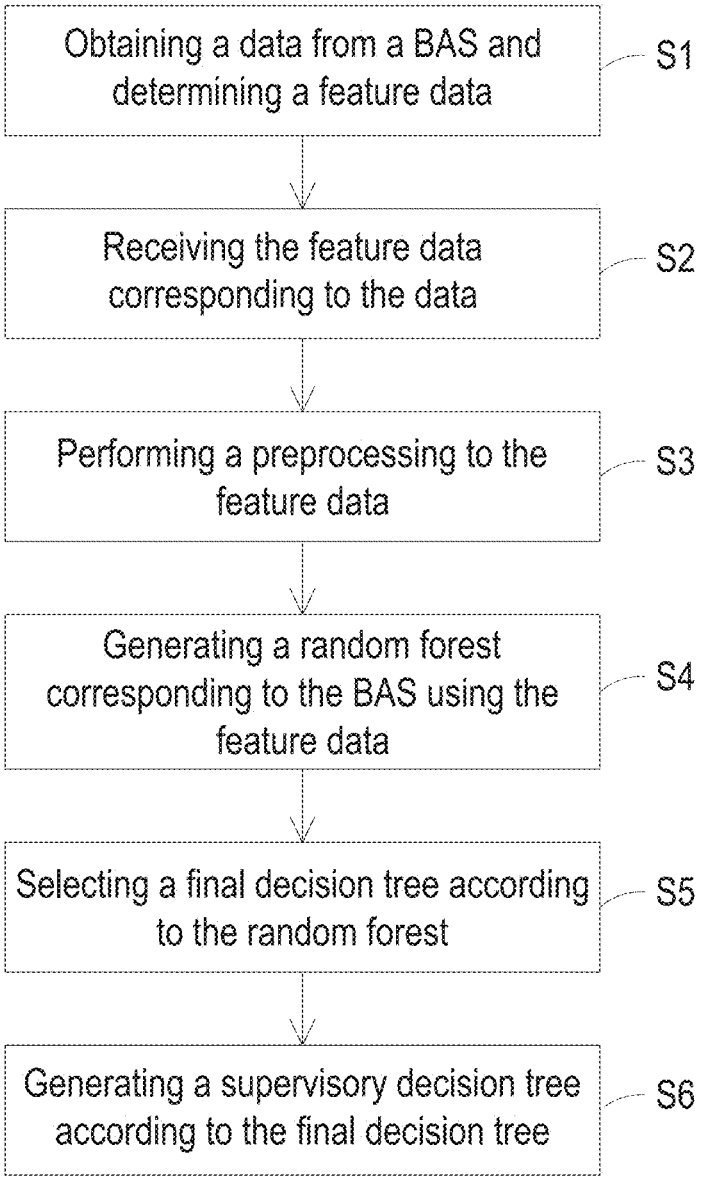
FIG. 6 is a schematic flow chart illustrating a control engine method according to an embodiment of the present disclosure.

FIG. 6 is a schematic flow chart illustrating a control engine method according to an embodiment of the present disclosure. The control engine method of the present disclosure is applicable for the control engine system 1 stated above. Please refer to FIG. 6, which illustrates the data-driven rule extraction for transferable predictive control heuristics of the present disclosure. The rule extraction may be performed by an agnostic control engine (ACE) of the present disclosure stated above. The control engine method of the present disclosure includes steps S1, S2, S3, S4, S5, and S6. In the step S1, the data from the BAS 6 is obtained, and feature data corresponding to the data is determined. The features may include inputs and outputs of the BAS 6, input is for example but not limited to at least one of the states (the modeled parameter in the control loop), inputs (button presses, occupancy, etc.) and disturbances (temperature, humidity, solar radiation, etc.). Different BAS may have different structures for different application scenarios, and thus the features required for each system may be different. For example, one HVAC system might need a first set of features representing temperature, humidity, air quality and lighting control and a lighting system might need a set of features representing color, brightness, etc. The present disclosure can be adapted for different BAS in different areas of use.

In the step S2, the feature data corresponding to the features of the BAS 6 is received. The feature data can be collected from devices located in the building/facility to be controlled by the system. For example, BAS controller, DX air conditioner, camera, thermal sensor, cloud data center, etc.

In the step S3, a preprocessing to the feature data is performed by the data preprocessing engine 2. Feature data can be filtered, cleaned, rearranged, reordered, and normalized for the use in generation of random forests. Specifically, the data is normalized to fill missing values using interpolation for continuous data and previous value for event-based data. This is to ensure that data of different features and/or from different devices would be in the same form, or similar purpose. The normalized data is then sliced and shuffled stochastically to produce multiple unique 50-50 train-test splits for cross-validation. The number of uniquely shuffled datasets generated from the original sample data matches the number of trees that will be generated in the random forest. The data is shuffled to prevent overfit and allow for multiple similar systems in a larger dataset to have a single representative heuristic solution to improve implementation efficiency. Using stochastic shuffle is to avoid overfit and provide flexible models that can work for multiple similar systems over a variety of ambient conditions.

In the step S4, a random forest of classification trees corresponding to the BAS 6 using the feature data is generated by the random forest generator 3. A statistically significant random forest of classification trees is generated using, for example a CART algorithm. Other algorithms might also be used (such as ID3 algorithm, C4.5 algorithm, and other algorithms that include the classification tree itself as an accessible output). The statistical significance information is provided by the user if the system is small or has unique characteristics when compared to similar datasets, and is used to indicate adjust the size of the random forest to control accuracy and overfit. If statistical significance information is not provided then a default random forest of 1,000 trees is generated.

Figure 7:
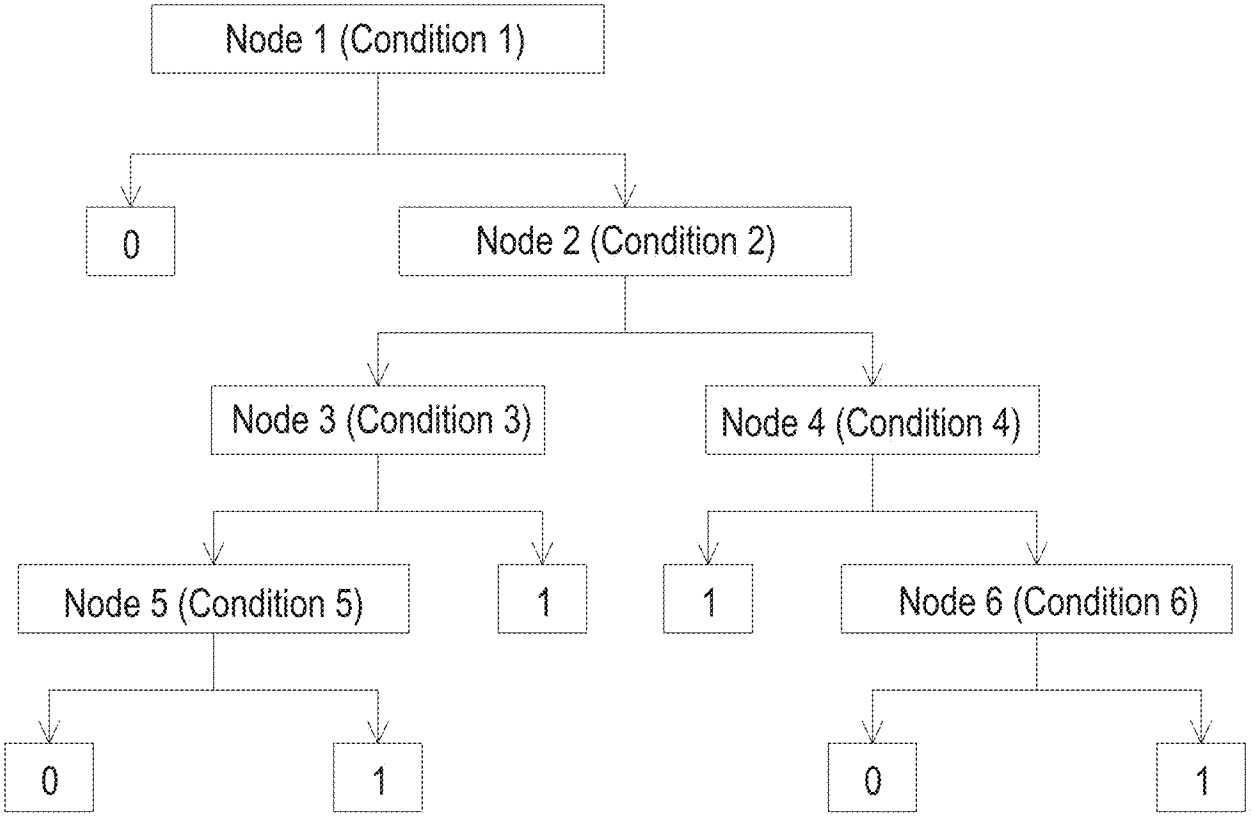
FIG. 7 is a schematic diagram of a decision tree generated by the tree selector in FIG. 2.

In the step S5, a final decision tree is selected according to the random forest by the tree selector 4. In an embodiment, the final decision tree is selected based on an error value jump or inflection point in tree complexity. The previously described process to generate the decision tree node is implemented in FIG. 4 and FIG. 5 and applied in here. An example final decision tree generation is shown in FIG. 7 for a system with 6 arbitrary selected nodes and one binary output.

In the step S6, the supervisory decision tree is generated according to the final decision tree by the BAS code generator 5 and is applied to the BAS. In an embodiment, the supervisory decision tree is applied to override control mode in place of full algorithm when energy can be saved and/or comfort can be improved. The final decision tree from FIG. 7 is then applied to override the system mode in a similar format to the original predictive controller.

In the present embodiment, an approach to generating empirical rule extraction heuristics to fundamental control processes is disclosed. The process may utilize time series feature data from the BAS from selected features of VAV, DX, AHU and/or BAS controllers (and/or other building systems) that are mapped to at least one of system states, inputs, disturbances (e.g., thermal sensors), and controlled outputs (e.g., system mode). In an embodiment, other sensor data in time series may also be utilized, such as humidity, brightness, etc., depending on the control requirements. The decision trees representing the optimal tree for both simplicity and maintenance of the abstracted and extracted algorithm are applied for systems capable of reselecting only the most impactful features for system mode of the underlying system. The decision trees can then be applied to adjust the system mode based on the thermal sensor behavior from historical time series data. This process results in comparable energy savings to detailed algorithms while also being explainable to field practitioners and implementable with Boolean logic gates.

Figure 8:
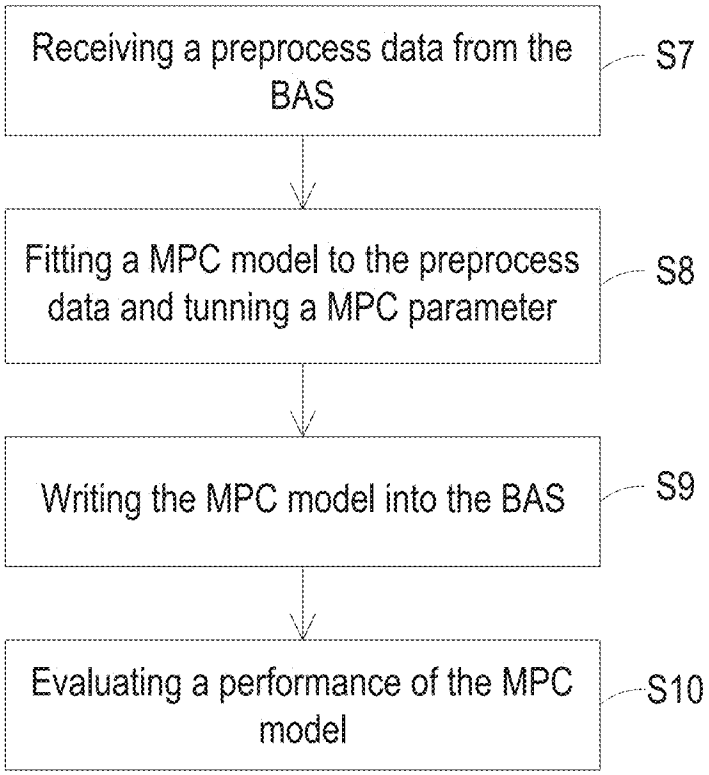
FIG. 8 is a schematic flow chart illustrating a control engine method for MPC configuration according to an embodiment of the present disclosure.

Please refer to FIG. 8, which is a schematic flow chart illustrating a control engine method for MPC configuration according to an embodiment of the present disclosure. The MPC may be implemented in the BAS 6 and controlled by the decision tree generated by the control engine system 1 of FIG. 2. A configuration tool performing the process of FIG. 8 may be utilized to support the execution of the rule extraction for predictive control heuristics of FIG. 7. The configuration tool may interface with the MPC of BAS and the ACE to achieve the purpose of controller improvement for better energy savings and efficiencies. The control engine method for a MPC configuration of the present disclosure is applicable for the control engine system 1 stated above. The control engine method for a MPC configuration includes steps of the control engine method shown in FIG. 6. Please refer to FIG. 8, the control engine method for a MPC configuration of the present disclosure includes steps S7, S8, S9, and S10. In the step S7, a preprocess data from the BAS 6 is received. The preprocess data may at least include: mapping the model parameters to system tags, connecting to, configuring, collecting and cleaning historical data from the system data.

In the step S8, a MPC model is fitted to the preprocess data and a MPC parameter of the MPC model is tuned for a desired optimal performance of a control object. The preprocess data could be sensor data for example but not limited to thermal data, and the parameters could include hyper parameters, for example. The step S8 is usually a tradeoff between thermal comfort via thermal setpoints and energy usage as quantified by a constant that allows for differentiation of its equating values. In an embodiment, the step S8 may include at least: fitting linear time-invariant state-space sensor models to the system data, developing MPC hyperparameters for periodic cost function evaluation, etc. The control object is for example but not limited to a damper position, a setpoint, or a binary state.

In the step S9, the MPC model is written into the BAS 6 to override an original control of the BAS 6 when energy savings or improved thermal comfort are predicted by a different control mode than the default algorithm.

In the step S10, the performance of the MPC model is evaluated. The evaluation of performance may include at least: estimation of potential performance improvement, periodic evaluation of algorithm performance by comparing the actual system response to estimates, and re-fitting or re-training the model as the underlying system changes are identified.

Based on the evaluation result of the step S10, the process may repeat steps S7-S9 in an iterative nature in order to achieve more stable and/or better performance.

Please refer to FIG. 8 again, in the step S7, the available controller inputs, parameters, and/or outputs are first identified to determine the potential states, inputs, disturbances, and/or controlled outputs. The inputs may be utilized for the use by the ACE of FIGS. 1 and 2 for performing the rule extraction process of FIG. 6.

Figure 9:
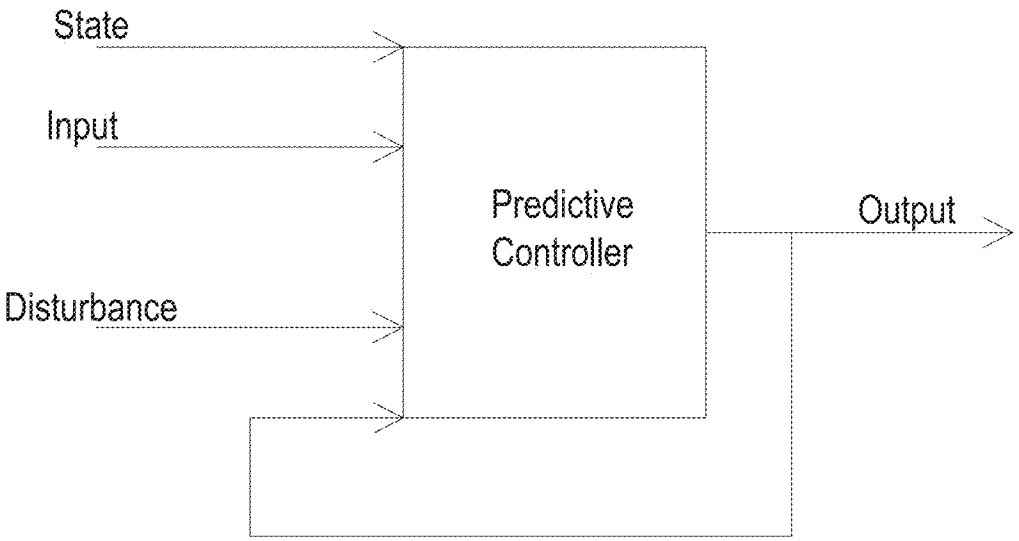
FIG. 9 is a schematic diagram of a predictive controller process according to an embodiment of the present disclosure.

Time series data from the selected features can be then mapped by the user through a manual selection interface of the configuration tool, so as to represent a process shown in FIG. 9, which is similar to the process of the ACE of FIG. 1. BACnet trend-log objects may be used to obtain historical data and the referenced objects may be queried over BACnet to get the present values to allow the user to validate that the correct object has been selected.

Timestamps from the linked data are used to interpolate and align trend-log data from the BAS. A first typical controller input is used as the input that corresponds with the setpoint, this is used as one of the inputs to the cost function. Other inputs and/or disturbances are also used to model the system response but they may not be considered in the optimization process because they might not be the controlled inputs. The optimization process is also linked to external or derived data such as energy cost which can be estimated using a virtual sensor or other model in the absence of direct data.

Please refer to FIG. 8 again, in the embodiment, in the step S8, model fitting uses least squares fitting to generate linear time-invariant multi-input models of a state (usually temperature) to a predict system response at the next time step. Time steps may be 30 minutes by default to take advantage of typical thermal mass properties of buildings. However, other time steps may also be chosen depending on control requirements and/or demands. Predictions for all typical controller inputs are either linked to real-time (or near real-time) predictions and canonical MPC reduction methods from state-space models are applied to generate a Hessian for predetermined time steps, for example six-time steps (three hours). The Hessian is a highly nonlinear function of thermal mass parameters from the state-space model and a weighted matrix of penalty values for different timesteps to assist with balancing the process for load allocation. In the present embodiment, the penalty matrix may be the identity matrix. The Hessian is then used to predict the change in energy provided by the HVAC system for the modeled zone over each time step in the prediction horizon to optimally satisfy the cost function. Since many HVAC systems can only change modes seasonally, direct control is eased by only applying an override in situations when the MPC process determines that the HVAC system will overshoot the setpoint.

In the step S9, the algorithm is deployed with the reduced BAS code to drive this operation using the existing BAS points sent to the BAS controller. A verification process where the overrode MPC are compared to the tools anticipated values executing for a predetermined period of operation, for example one week, to verify the reduced code deploys correctly to the BAS controller.

In the step S10, the performance of the overrode MPC with respect to the cost function inputs is evaluated on-demand using the configuration tool to estimate how much energy is saved and how much occupant dissatisfaction occurs as a result of the control overrides. Occupant dissatisfaction is defined as a button press to modify the setpoint on the occupant's thermostat or if ASHRAE Standards 55 or 62.1 are violated. Resultantly, the tool and the controller have a bi-directional relationship over the MPC tuning process.

In the present disclosure, an approach to an automated model-based predictive control controller configuration tool is disclosed. The process uses time series data from selected features that are mapped to system states, inputs, disturbances, and controlled outputs to generate a data-driven MPC algorithm to simultaneously reduce energy use and control typical controller input to the setpoint (shown in FIG. 2). The process generates a fundamental canonical MPC scheme that is evaluated for energy saving potential and fed back into the BAS controller to augment the control process. The configuration tool also verifies the deployed algorithm and validates energy performance and setpoint conformance.

From the above descriptions, the present disclosure provides a process to extract fundamental rules from a full-scale MPC or other predictive MIMO control schemes using a defined approach that optimizes a heuristic structure for ease of implementation of the underlying optimization function from the original algorithm. The embodiment provides the process of abstracting and extracting the intent of the underlying algorithm through systematic feature selection to generate heuristic "trees" for MIMO application that can be implemented with real-time telemetry, logic gates, and dynamic evaluation of performance.

The embodiment of the present disclosure enables the use of predictive control in a resource-constrained environment with minimal historical data input for a training phase of MPC implementation. The systematic process greatly reduces the feature requirements while maintaining most of the performance of the underlying algorithm. Additionally, the trees generated in the process can be used to intuitively evaluate their validity in ways that cannot be realized with more complicated process that contain many unitless parameters. The indicative tree selected by the process can be used in place of the underlying control and applied as a transfer learning approach over a large group of systems with similar characteristics.

Automated detection of relevant model features, collecting and configuration of relevant historical time-series data, fitting of a thermal model to historical data from a normalized repository, multi-objective optimization and predictive feature forward modeling are combined in commercial tooling to automate the bulk of the MPC configuration process at the BAS microcontroller level. BAS points are mapped to MPC parameter requirements, and historical data is collected to train linear time-invariant state-space models that can be used to predict future states of the zone served by the controller and to optimize output response based on the defined cost function. The resulting algorithm output is then deployed in a supervisory format to modulate equipment based on the predicted disturbances over the defined time horizon. The configured MPC output can control equipment modes or other adjustable BAS objects that control the thermal response of the corresponding conditioned zone.

Also, the embodiment of the present disclosure enables the configuration and deployment of predictive control in a resource-constrained environment. The process streamlines the implementation of MPC in buildings for practitioners while standardizing the process in a fundamental canonical format that can be easily interpreted by both humans and machines.

The present disclosure differentiates itself from existing material in this field because it doesn't specify needing a setpoint or direct equipment control as the feedback mechanism (both, and more, are options and depend on the underlying desired control features that are extracted).

The present disclosure further differentiates itself from existing material in this field because it focuses on the tooling and configuration of MPC algorithms, regardless the types and specifics of the MPC algorithms. The algorithm demonstrated in this tool can be a fundamental canonical MPC algorithm that has been in the public domain for decades, or newly developing one. The tooling in the disclosure facilitates the usage of a conventional MPC algorithm or any other similar algorithm serving a similar purpose.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A control engine system connected to a building automation system (BAS), comprising:

a data preprocessing engine, wherein the data preprocessing engine is adapted to receive a data from the BAS and configured for performing preprocessing on the data and generating a training data accordingly;

a random forest generator, connected to the data preprocessing engine, wherein the random forest generator is configured to receive the training data and generate a random forest according to the training data;

a tree selector, connected to the random forest generator, wherein the tree selector is configured to receive the random forest for selecting a final decision tree; and a BAS code generator, connected to the tree selector, wherein the BAS code generator is configured to receive the final decision tree and encode a supervisory decision tree according to the final decision tree, and the BAS code generator is configured to output the supervisory decision tree to the BAS, wherein the supervisory decision tree is applied to the BAS to save energy and/or improve comfort.

2. The control engine system according to claim 1, wherein the tree selector comprises a criteria-based indicative tree selector.

3. The control engine system according to claim 1, wherein the data from the BAS comprises at least one of a control structure and a thermal sensor data.

4. The control engine system according to claim 1, wherein the preprocessing of the data preprocessing engine comprises at least one of the normalizing, slicing, and shuffling of the data.

5. The control engine system according to claim 1, wherein the random forest generator is configured to generate the random forest using a classification and regression tree (CART) algorithm.

6. The control engine system according to claim 1, wherein the control engine system comprises an agnostic control engine (ACE).

7. A control engine method, applicable for a control engine system, wherein the control engine system is connected to a BAS and comprises a data preprocessing engine, a random forest generator, a tree selector and a BAS code generator, and the control engine method comprises steps of:

(a) obtaining a data from a BAS and determining a feature data corresponding to the data;

(b) receiving the feature data corresponding to the data;

(c) performing a preprocessing to the feature data by the data preprocessing engine;

(d) generating a random forest corresponding to the BAS using the feature data by the random forest generator;

(e) selecting a final decision tree according to the random forest by the tree selector; and (f) generating a supervisory decision tree according to the final decision tree by the BAS code generator, wherein the supervisory decision tree is applied to the BAS to save energy and/or improve comfort.

8. The control engine method according to claim 7, wherein the feature data comprises at least of the states, inputs, disturbances or outputs of the BAS.

9. The control engine method according to claim 7, wherein the random forest is statistically significant and/or of a default number of trees.

10. The control engine method according to claim 7, further comprising a step of: sorting the random forest by a node count to produce the final decision tree.

11. A control engine method for a model-based predictive control (MPC) configuration, comprising the steps of the control engine method of claim 7, and further comprising steps of:

(g) receiving preprocess data from the BAS;

(h) fitting a MPC model to the preprocess data and tunning a MPC parameter of the MPC model for a desired optimal performance of a control object;

(i) writing the MPC model into the BAS to override an original control of the BAS; and (j) evaluating the performance of the MPC model.

12. The control engine method according to claim 11, wherein the preprocess data is in time series.

13. The control engine method according to claim 11, wherein in the step (h), the fitting of the MPC model is performed by using least squares fitting, and the MPC model comprises a linear time-invariant multi-input model.

14. The control engine method according to claim 11, wherein in the step (h), the fitting of the MPC model is performed by using a nonlinear function of parameters from a state-space model.

15. The control engine method according to claim 11, wherein the evaluation of the performance of the MPC model comprises steps of: estimating a potential performance improvement or a periodic evaluation of the MPC model performance comparing to estimates, and re-fitting or re-training the MPC model.

* * * * *